US007563976B2

(12) United States Patent
Sim

(10) Patent No.: US 7,563,976 B2
(45) Date of Patent: Jul. 21, 2009

(54) APPARATUS AND METHOD FOR PROCESSING AT LEAST ONE MIDI SIGNAL

(75) Inventor: Wong Hoo Sim, Singapore (SG)

(73) Assignee: Creative Technology Ltd, Singapore (SG)

( * ) Notice: Subject to any disclaimer, the term of this patent is extended or adjusted under 35 U.S.C. 154(b) by 0 days.

(21) Appl. No.: 11/779,842

(22) Filed: Jul. 18, 2007

(65) Prior Publication Data

US 2009/0019998 A1 Jan. 22, 2009

(51) Int. Cl.
*G10H 7/00* (2006.01)

(52) U.S. Cl. ..... 84/645; 84/622; 84/625; 84/659; 84/660

(58) Field of Classification Search ..... None
See application file for complete search history.

(56) References Cited

U.S. PATENT DOCUMENTS 5,194,682 A * 3/1993 Okamura et al. ..... 434/307 A
5,235,124 A * 8/1993 Okamura et al. ..... 434/307 A
5,250,745 A * 10/1993 Tsumura ..... 434/307 A
5,286,907 A * 2/1994 Okamura et al. ..... 434/307 A
5,402,499 A 3/1995 Robison et al.
5,424,487 A * 6/1995 Shioda ..... 84/630
5,565,641 A * 10/1996 Gruenbaum ..... 84/615
5,886,275 A * 3/1999 Kato et al. ..... 84/609
5,889,224 A * 3/1999 Tanaka ..... 84/645
6,640,257 B1 * 10/2003 MacFarlane ..... 710/1
2003/0121401 A1 * 7/2003 Ito ..... 84/625
2004/0206226 A1 * 10/2004 Negoescu et al. ..... 84/600
2005/0056143 A1 * 3/2005 Fay ..... 84/645

* cited by examiner

*Primary Examiner*—Marlon T Fletcher

(57) ABSTRACT

There is provided an apparatus for processing at least one MIDI signal. The apparatus includes a first input for receiving MIDI signals, a second input connected to an audio output of a sound generating device for receiving analog signals, a digital-analog converter coupled to the first input for converting the MIDI signals into analog signals, and a summing circuit for summing the converted MIDI signals from the first input and the analog signals from the second input. A resultant signal from the summing circuit may be output from a connector of the apparatus. The connector may be for connection to a sound reproduction apparatus. Preferably, the first and the second inputs allow input of signals either by a wired connection or wirelessly. There is also provided a corresponding method for processing data from a sound generating device.

12 Claims, 2 Drawing Sheets

APPARATUS AND METHOD FOR PROCESSING AT LEAST ONE MIDI SIGNAL

FIELD OF INVENTION

This invention relates to an apparatus for processing MIDI signals from a sound generating apparatus. A corresponding method for processing MIDI signals from a sound generating apparatus is also disclosed.

BACKGROUND

Musicians using digital sound generating apparatus such as, for example, an electronic musical keyboard, a Prodikeys keyboard from Creative Technology Ltd, and an electronic device for generating music usually have controls which allow them to process their work product generated using the apparatus. The aforementioned apparatus have evolved to an extent whereby the work product generated using the apparatus is able to be varied significantly using the controls on the apparatus.

A headphone/earphone/speaker output for such digital sound generating apparatus is usually used solely for the purpose of reviewing the work product generated using the apparatus. The headphone/earphone/speaker output provides an output of analog signals which are not combinable with other outputs from the digital sound generating apparatus. In this regard, there has not been an output from any digital sound generating apparatus which combines output of different forms into a single output for playback/review by the musician. This may enable an alternative work product to be generated by the musician using the digital sound generating apparatus which may not have been possible otherwise. Being able to process at least one output from the digital sound generating apparatus may also allow the digital sound generating apparatus to remain usable in light of developments in digital sound processing technology. The musician may then avoid the need to constantly change the digital sound generating apparatus to cope with changes in digital sound processing technology.

SUMMARY

In a first aspect, there is provided an apparatus for processing at least one MIDI signal. The apparatus includes a first input for receiving MIDI signals, a second input connected to an audio output of a sound generating device for receiving analog signals, a digital-analog converter coupled to the first input for converting the MIDI signals into analog signals, and a summing circuit for summing the converted MIDI signals from the first input and the analog signals from the second input. A resultant signal from the summing circuit may be output from a connector of the apparatus. The connector may be for connection to a sound reproduction apparatus. Preferably, the first and the second inputs allow input of signals either by a wired connection or wirelessly.

Preferably, the apparatus may further include a controller for processing the resultant signal from the summing circuit. The resultant signal may advantageously be processed in a manner such as, for example, by amplifying the signal, by restoring the signal to approximately its original form, by enhancing the signal using Creative Technology Ltd's X-Fi technology, by augmenting signals to high definition format and the like. The apparatus may further include a port for input of data to either the digital-analog converter or the controller.

This port may be for either wired or wireless reception of data. The wired port may have a connector like a USB connector, an IEEE 1394 connector, or a proprietary connector. Alternatively, the wireless port may use wireless technologies like UWB, Bluetooth, infrared, or any form of radio frequency transmission. The data being input may be selected from information relating to the sound generating device, and instructions for processing the resultant signal. The port may include a switch for selecting the input of data to either the digital-analog converter or the controller.

It is preferable that the sound generating device is selected from, for example, an electronic musical keyboard, a Prodikeys keyboard from Creative Technology Ltd, an electronic device for generating musical work product and so forth.

In a second aspect, there is provided a method for processing data from a sound generating device. The method includes receiving MIDI signals through a first input of an apparatus, receiving analog signals through a second input of the apparatus, converting the MIDI signals using a digital-analog converter in the apparatus, summing the converted MIDI signals and the analog signals with a summing circuit in the apparatus, and outputting a resultant signal from the summing circuit. The method may further include processing the resultant signal from the summing circuit.

Advantageously, the resultant signal may be processed in a manner such as, for example, by amplifying the signal, by restoring the signal to approximately its original form, by enhancing the signal using Creative Technology Ltd's X-Fi technology, by augmenting signals to high definition format and the like.

It is preferable that the sound generating device may be, for example, an electronic musical keyboard, a Prodikeys keyboard from Creative Technology Ltd, and an electronic device for generating music.

DESCRIPTION OF DRAWINGS

In order that the present invention may be fully understood and readily put into practical effect, there shall now be described by way of non-limitative example only preferred embodiments of the present invention, the description being with reference to the accompanying illustrative drawings.

DESCRIPTION OF PREFERRED EMBODIMENTS

Figure 1:
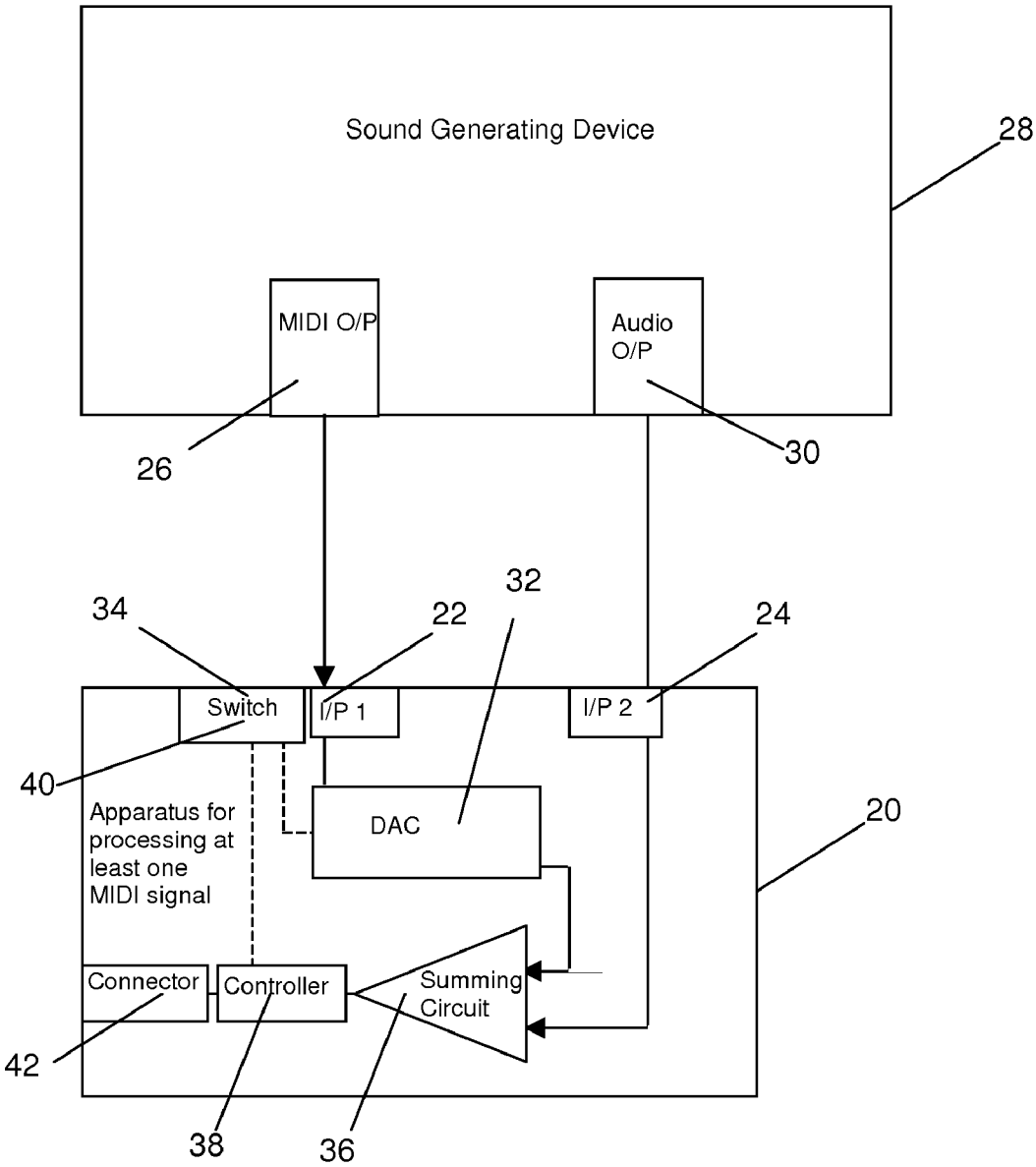
FIG. 1 shows a schematic diagram of the present invention.

Referring to FIG. 1, there is shown a schematic diagram of a preferred embodiment of the present invention. An apparatus 20 for processing at least one MIDI signal is shown. The apparatus 20 includes a first input 22 for receiving MIDI signals. The first input 22 may be a receptor, socket, connector or receiver of any form which enables wired/wireless input of MIDI signals into the apparatus 20. For example, the input 22 may be a USB connector, an IEEE 1394 connector, or a proprietary connector. The wireless receiver may operate with wireless technologies such as, for example, UWB, Bluetooth, infrared, or any form of radio frequency transmission. It is preferable that the first input 22 is connected to a MIDI output 26 of a sound generating device 28. The sound generating device 28 may be for example, an electronic musical keyboard, a Prodikeys keyboard from Creative Technology Ltd, or an electronic device for generating musical work product.

There may also be a second input 24. The second input 24 may be a receptor, socket, connector or receiver of any form which enables wired/wireless input of analog signals into the apparatus 20. For example, the second input 24 may be a USB connector, an IEEE 1394 connector, or a proprietary connector. The wireless receiver may operate with wireless technologies such as, for example, UWB, Bluetooth, infrared, or any form of radio frequency transmission. It is preferable that the second input 24 is connected to an audio output 30 of the sound generating device 28. The audio output 30 may be a headphone/earphone output which outputs analog signals.

In the preferred embodiment, the first input 22 may be coupled to a digital-analog converter 32, the digital-analog converter 32 being for converting MIDI signals into analog signals. When the sound generating device 28 does not have controls for determining a level of output for each of the MIDI output 26 and the audio output 30, a MIDI signal converted by the digital-analog converter 32 would generate an analog signal that is substantially identical to the analog signal transmitted from the audio output 30. The digital-analog converter 32 may preferably be able to receive inputs through a port 34 such that conversion of the MIDI signal through the first input 22 is optimized (minimal losses) in accordance with a make and model of the sound generating device 28. The port 34 may enable information in relation to the make and model of the sound generating device 28 to be transmitted to the digital-analog converter 32. It should be noted that the port 34 may be a receptor, socket, connector or wireless receiver of any form. For example, the port 34 may be a USB connector, an IEEE 1394 connector, or a proprietary connector. The wireless receiver may operate with wireless technologies such as, for example, UWB, Bluetooth, infrared, or any form of radio frequency transmission.

The apparatus 20 may also include a summing circuit 36 for summing the converted MIDI signals from the first input 22 and the analog signals from the second input 24. The summing circuit 36 would add the signals in analog form and transmit a resultant signal. The apparatus 20 may also include a controller 38 for processing the resultant signal. The controller 38 may preferably be able to receive data through the port 34. The data through the port 34 may include instructions for the controller 38 to process the resultant signal. The port 34 may include a switch 40 for selecting the input of data to either the digital-analog converter 32 or the controller 38. The resultant signal may be processed by the controller 38 in a manner such as, for example, by amplifying the signal, by restoring the signal to approximately its original form, by enhancing the signal using Creative Technology Ltd's X-Fi technology or by augmenting signals to high definition format.

The resultant signal processed by the controller 38 may be output from a connector 42 of the apparatus 20. The connector 42 may be for connection to a sound reproduction apparatus such as, for example, earphones, headphones or speakers.

Figure 2:
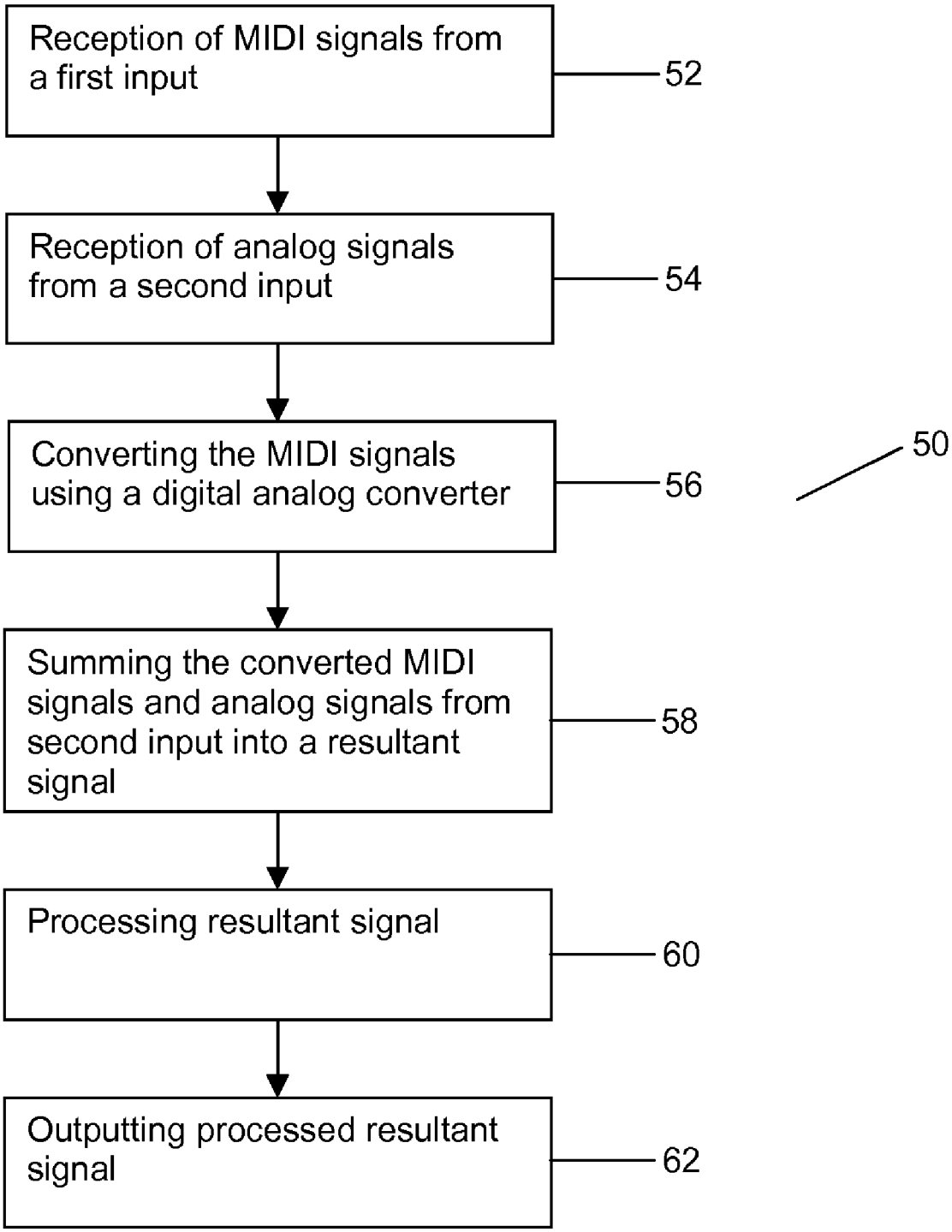
FIG. 2 shows a process flow of a method of the present invention.

In another aspect of the present invention, there is shown in FIG. 2 a method 50 for processing data from a sound generating device. The sound generating device may be, for example, an electronic musical keyboard, a Prodikeys keyboard from Creative Technology Ltd, or an electronic device for generating music. The method 50 includes receiving MIDI signals through a first input of an apparatus 52. Analog signals are received through a second input 54. The method 50 does not distinguish an order of reception of the MIDI and analog signals. The analog and MIDI signals may be received by the apparatus either through a physical connection or wirelessly. The MIDI signals are subsequently converted using a digital-analog converter 56 in the apparatus. After the MIDI signals are converted, the converted MIDI signals and the analog signals from the second input are passed into a summing circuit 58 of the apparatus. A resultant signal generated from the summing circuit 58 may be subjected to processing 60. The resultant signal may be processed in a manner such as, for example, by amplifying the signal, by restoring the signal to approximately its original form, by enhancing the signal using Creative Technology Ltd's X-Fi technology or by augmenting signals to high definition format. Finally, the processed resultant signal may be output from the apparatus.

Whilst there has been described in the foregoing description preferred embodiments of the present invention, it will be understood by those skilled in the technology concerned that many variations or modifications in details of design or construction may be made without departing from the present invention.

The invention claimed is:

1. An apparatus for processing at least one MIDI signal, including:

a first input for receiving MIDI signals from a MIDI output from a sound generating device;

a second input connected to an audio output of the sound generating device for receiving analog signals;

a digital-analog convener coupled to the first input for convening the MIDI signals into analog signals; and a summing circuit for summing the converted MIDI signals from the first input and the analog signals from the second input;

wherein a resultant signal from the summing circuit is output from a connector of the apparatus, the resultant signal being a summation of signals from the sound generating device.

2. The apparatus of claim 1, further including a controller for processing the resultant signal from the summing circuit.

3. The apparatus of claim 2, wherein the resultant signal is processed in a manner selected from the group comprising: by amplifying the signal, by restoring the signal to approximately its original form, by enhancing the signal using proprietary technology and by augmenting signals to high definition format.

4. The apparatus of claim 1, wherein the sound generating device is selected from the group consisting of: an electronic musical keyboard, a musical and alphanumeric keyboard combination, and an electronic device for generating musical work product.

5. The apparatus of claim 2, further including a port for input of data to either the digital-analog convener or the controller.

6. The apparatus of claim 5, wherein the port is for either wired or wireless reception of data.

7. The apparatus of claim 6, wherein the wired port has a connector selected from the group consisting of: a USB connector, an IEEE 1394 connector, and a proprietary connector.

8. The apparatus of claim 6, wherein the wireless port uses wireless technologies selected from the group consisting of: UWB, Bluetooth, infrared, and any form of radio frequency transmission.

9. The apparatus of claim 5, wherein the data is selected from the group consisting of: information relating to the sound generating device, and instructions for processing the resultant signal.

10. The apparatus of claim 5, further including a switch at the port for selecting the input of data to either the digital-analog converter or the controller.

11. The apparatus of claim 1, wherein the connector is for connection to a sound reproduction apparatus.

12. The apparatus of claim 1, wherein the first and the second inputs allow input of signals either by a wired connection or wirelessly.

* * * * *